US006915833B2

(12) United States Patent
Hoffman

(10) Patent No.: US 6,915,833 B2
(45) Date of Patent: Jul. 12, 2005

(54) PORTABLE SCREEN WALL SECTION

(76) Inventor: Stacy Lee Hoffman, 85898 489th Ave., Chambers, NE (US) 68725

( * ) Notice: Subject to any disclaimer, the term of this patent is extended or adjusted under 35 U.S.C. 154(b) by 63 days.

(21) Appl. No.: 10/678,983

(22) Filed: Oct. 3, 2003

(65) Prior Publication Data

US 2005/0072538 A1 Apr. 7, 2005

(51) Int. Cl.[7] ..... A47G 5/00
(52) U.S. Cl. ..... 160/377; 160/89
(58) Field of Search ..... 160/89, 377, 381, 160/351, 113

(56) References Cited

U.S. PATENT DOCUMENTS 2,225,963 A * 12/1940 Carlson ..... 160/44
2,420,898 A * 5/1947 Miner ..... 135/154
2,532,837 A * 12/1950 De Puy ..... 160/377
3,455,366 A * 7/1969 Bogumil ..... 160/368.1
5,427,169 A * 6/1995 Saulters ..... 160/368.1
5,657,809 A * 8/1997 Longoria et al. ..... 160/369

* cited by examiner

*Primary Examiner*—Blair M. Johnson

(57) ABSTRACT

Portable screen wall section(s) are utilized to enclose an opening or openings of a building structure that is mostly and preferably made up of fabric and mesh screen or netting, to allow for an outdoor atmosphere, while eliminating the entry of unwanted insects and/or varmints inside an opening or openings of a building.

The portable screen wall section(s) leans against a building structure by the means of the support structure members allowing the elimination of holes, adhesive bonding and/or permanent attachments to a building and/or surrounding areas.

The portable screen wall sections can be used alone or are easily attached together to cover larger openings of a building.

5 Claims, 5 Drawing Sheets

PORTABLE SCREEN WALL SECTION

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates to a portable screen wall section to provide an outdoor atmosphere from within an opening or openings of a building structure.

2. Description of the Related Art

Examples of patented devices of which may be related to the present invention include U.S. Pat. No. 5,427,169; U.S. Pat. No. 3,455,366; U.S. Pat. No. 3,763,917; U.S. Pat. No. 4,673,019; U.S. Pat. No. 4,846,241; U.S. Pat. No. 4,874,028; U.S. Pat. No. 4,909,004; U.S. Pat. No. 5,271,449; U.S. Pat. No. 5,050,660; U.S. Pat. No. 5,553,648; U.S. Pat. No. 5,487,402 and U.S. Pat. No. 5,730,666.

U.S. Pat. No. 5,487,402 to Clary discloses a portable shelter with expandable frame that is supported by eyebolts that are permanently affixed to the support structure frame.

U.S. Pat. No. 5,553,648 to Goharjon discloses a portable wall system that is supported by rings and a pair of base components that are permanently affixed to the support structure frame.

In these respects, the portable screen wall section according to the present invention substantially departs from the designs of the prior art, and in so doing provides an apparatus primarily developed for the purpose of providing a portable screen wall section to an opening or openings of a building without support devices that require holes in and around a buildings sidewalls and ceiling area and/or without support devices permanently affixed to a main frames support structure and/or building.

There is a need for garage doors screens to be set up or installed without having to resort to pounding nails, screwing in screws, stapling or puncturing holes into the surrounding areas of a garage door as it results in a lot of effort and measuring to get these support devices in the correct aligning spots in order to correlate it with the opposite attachments. In the same essence there is a need for an aesthetically pleasing portable screen wall section that is more economical by providing few structural components, which also results in less complex systems.

BRIEF SUMMARY OF THE INVENTION

A primary object of the present invention is to provide a portable screen wall section that will provide an outdoor atmosphere without outdoor pests coming in an opening or openings of a building structure that does not require many and/or any drilling, screwing, nailing, stapling, staking or adhesives on a building structure or surrounding area, to install portable screen wall section(s).

A second object is to provide a portable screen wall section that can simply connect portable screen wall sections together or to be simply used alone.

Another object is to provide a portable screen wall section that may be utilized upon various sizes and types of building structures such as, single or double car garage door openings, covered patios, gazebos, porches, sun shelters and alike structures where installation means are attaching straps around a garage door track, a stud, a pillar, a column and alike fixed structures on a building.

A further object is to provide a portable screen wall section that is economical, while in the same means being aesthetically pleasing and simple and quick to set up.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
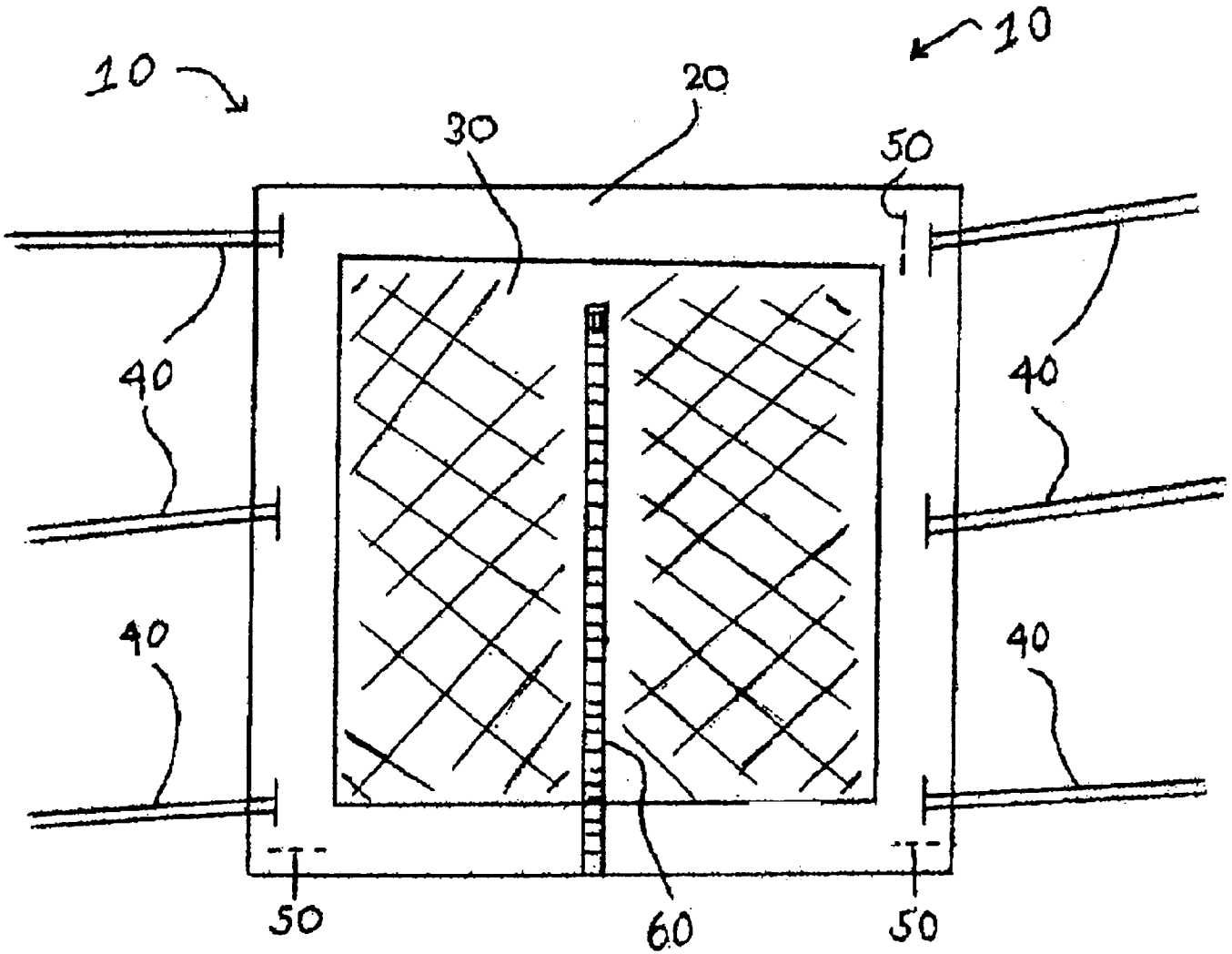
FIG. 1 is a perspective view of the front side and backside of the portable screen wall section.
Figure 2:
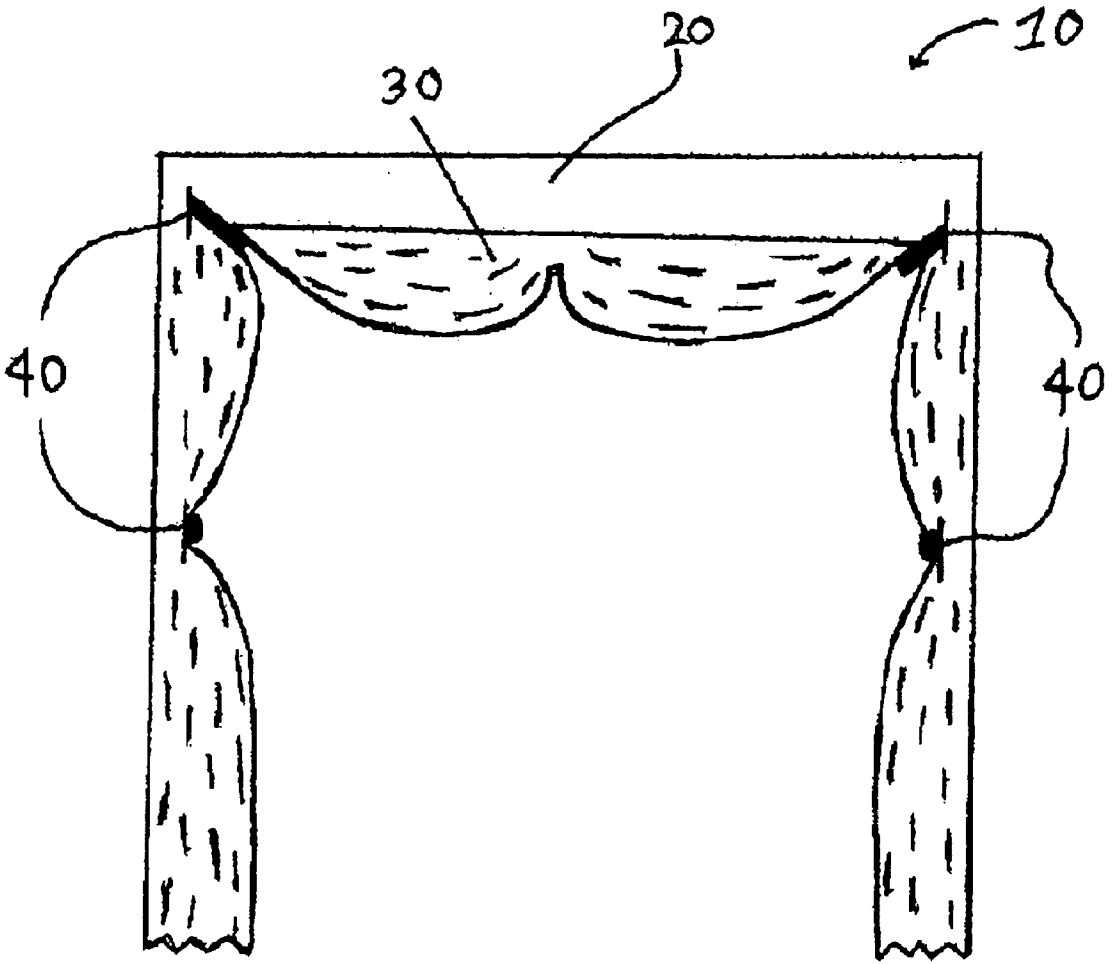
FIG. 2 is a perspective exterior view with the portable screen wall in open position.

Turning now descriptively to the drawings, FIGS. 1 and 2 illustrates a portable screen wall section 10, which comprises of fabric type material doubled up, being hollow inside, called hollow border 20 of which the support structure members 70 (illustrated in FIGS. 3 and 4) are placed inside, of which then holds the portable screen wall section 10 in an upright position for usage. The mesh screen 30 placed in the middle of hollow border 20 provides an interior and exterior view with natural air flow circulation, preventing the entry of insects, birds and other unwanted varmints when adjacent to an opening of a building 80 (also illustrated in FIG. 5). Straps 40 or similar devices are placed on the hollow border 20 providing portable screen wall sections to attach together when adjacent to an opening of a building 80 (also illustrated in FIG. 5) and/or to attach around a fixed building structure component 90 with or without screen 30 in open position (also illustrated in FIG. 5), and/or to hold back portions of the screen when opened at zipper 60, and/or keeps the screen 30 tight when the portable screen wall section(s) 10 are positioned adjacent to an opening of a building 80 on the outside, inside or between two fixed building structure components 90 (also illustrated in FIG. 5). Slits 50 are openings placed on the hollow border 20 of which openings provide the access to slide the support structure members 70 through (also illustrated in FIG. 3). Zipper 60 or the like devices may be incorporated but not restricted, into the portable screen wall section 10 to provide easy in and out traffic when not needing protection from the outdoor elements, without having to take the portable screen wall section 10 down and store away.

Figure 3:
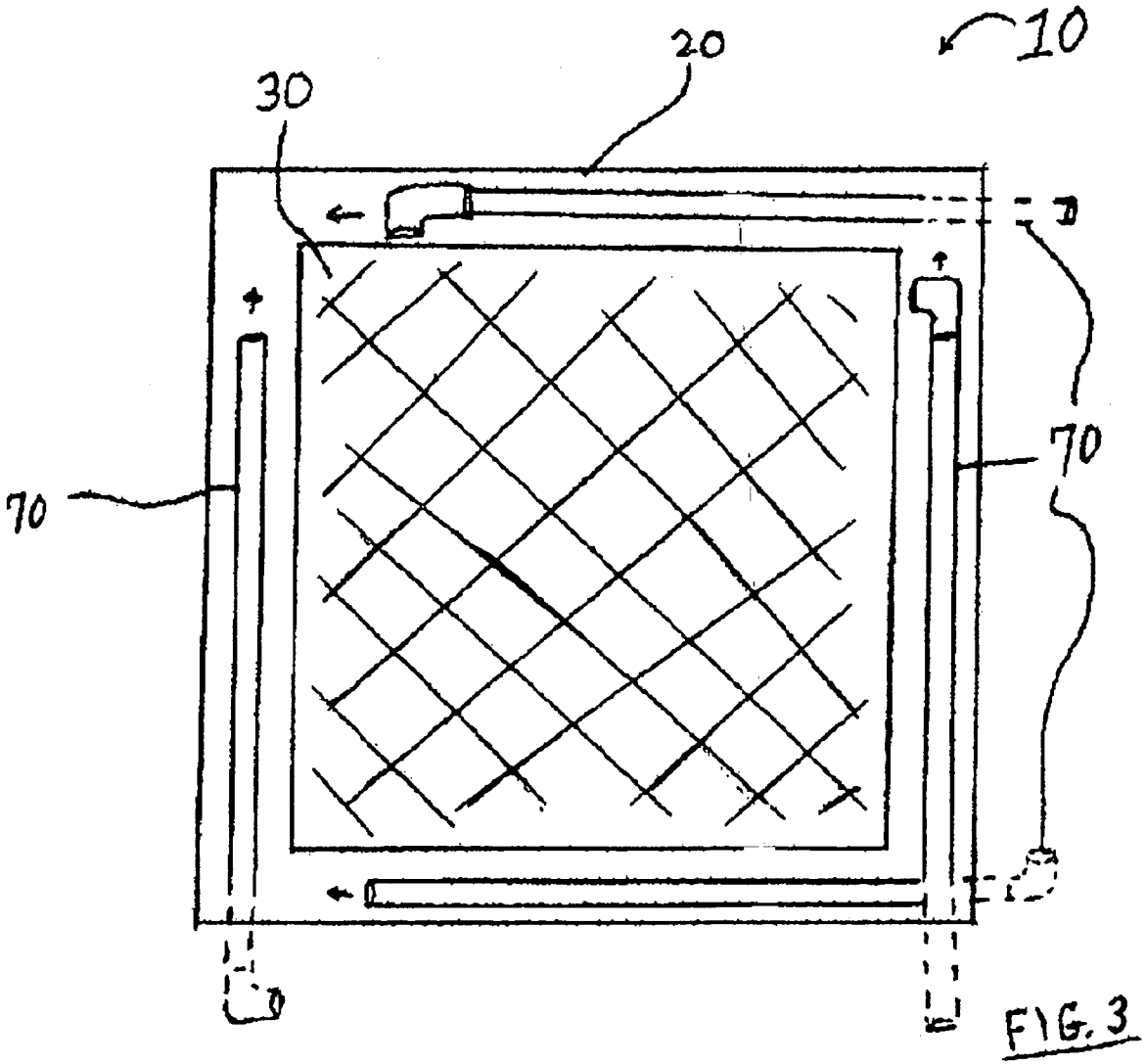
FIG. 3 is a perspective x-ray view of support structure members sliding into the portable screen wall sections hollow boarder.

FIG. 3 illustrates an x-ray view of the support structure members 70 sliding through the portable screen wall sections 10 and slits 50 of the hollow border 20.

Figure 4:
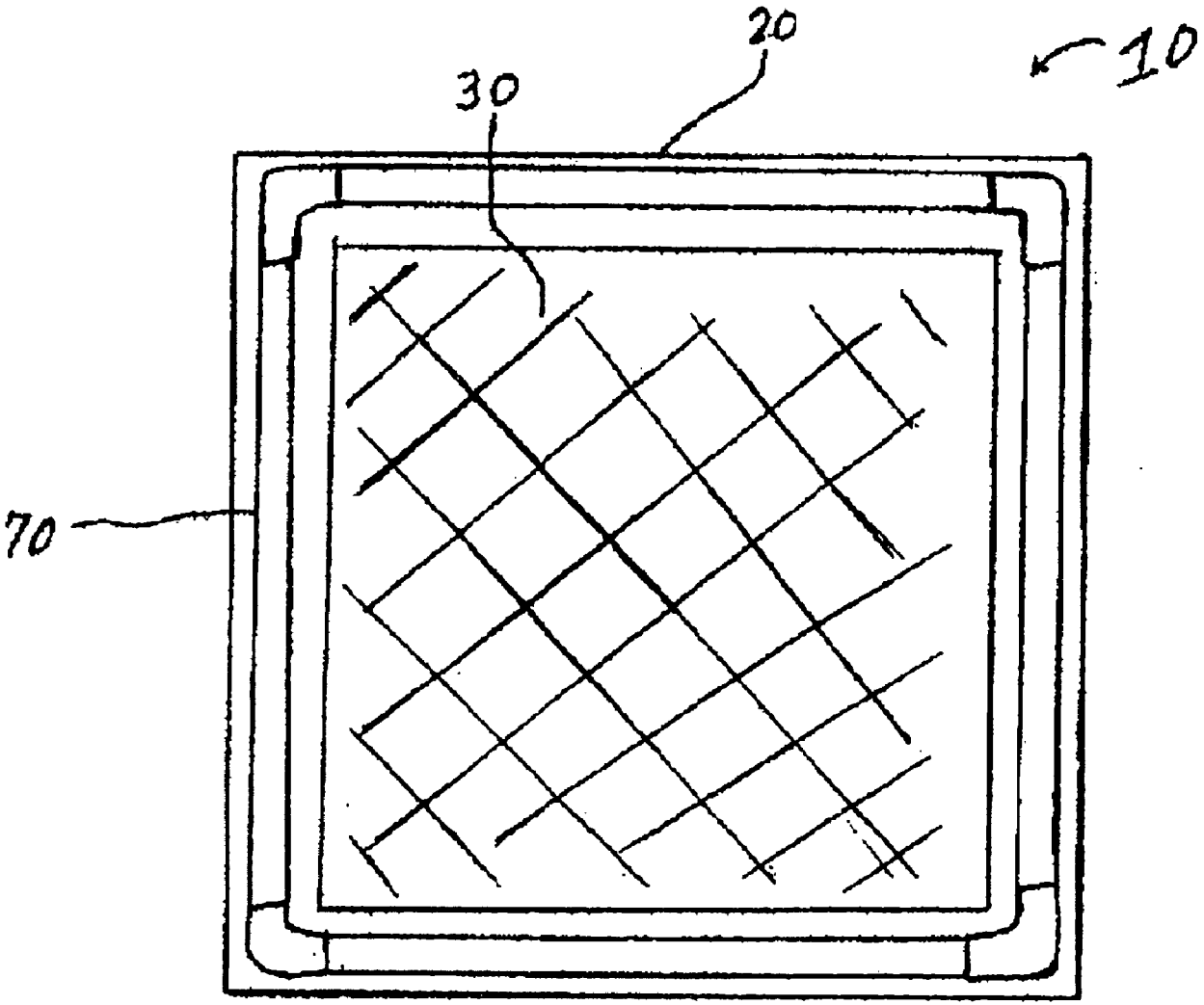
FIG. 4 is an x-ray view of the support structure members connected together inside the portable screen wall sections hollow border.

FIG. 4 illustrates an x-ray view of the support structure members 70 connected together inside the hollow border 20, providing the main support of the entire portable screen wall section. The support structure members 70 may consist of an inverted U and/or a square but not restricted to.

Figure 5:
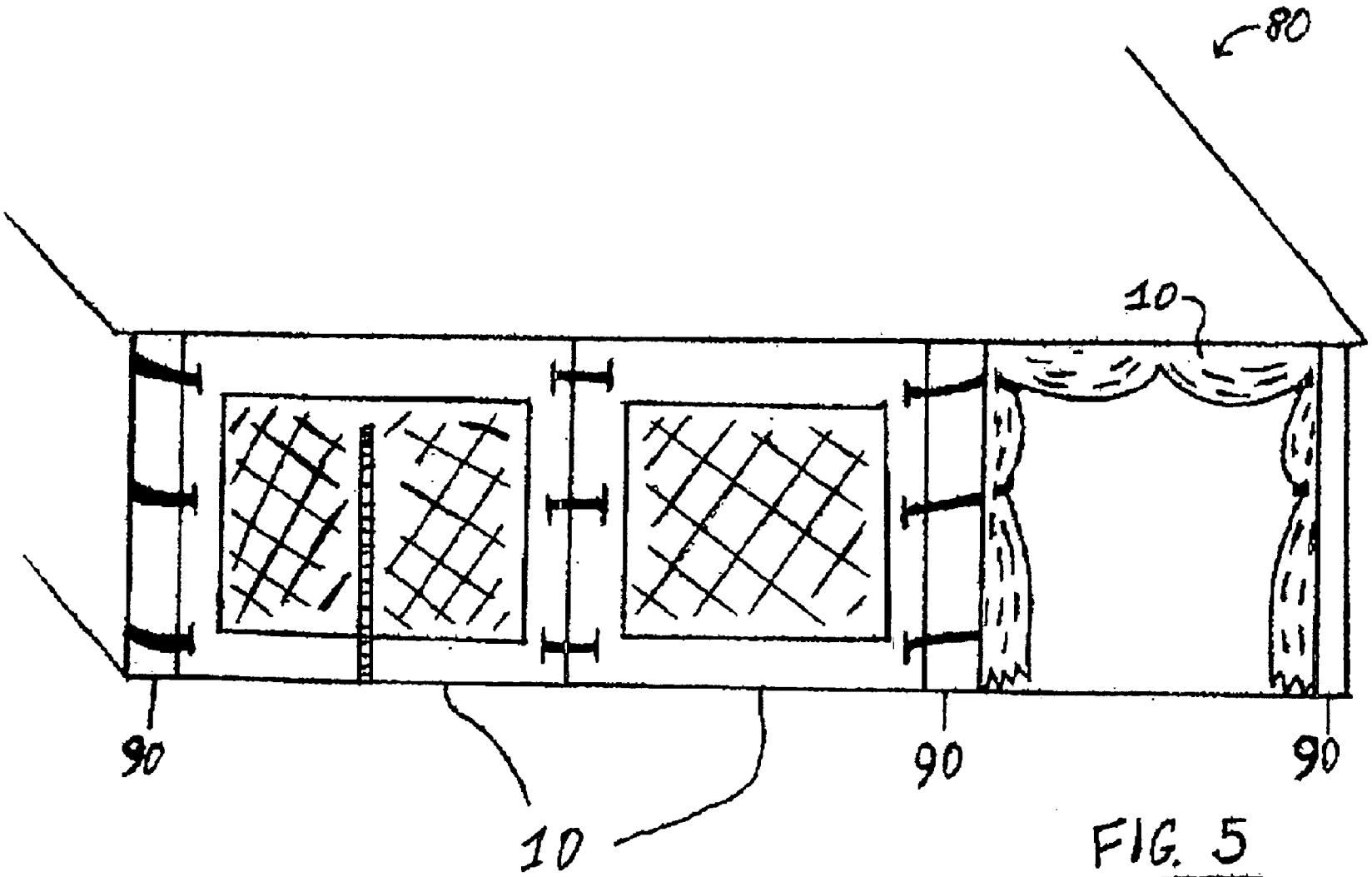
FIG. 5 is a perspective exterior view of the portable screen wall sections adjacent to a building with portable screen wall sections attached together and attached around building structure objects.

FIG. 5 illustrates the portable screen wall sections 10 in upright positions adjacent to openings of a building 80.

As to a further discussion of the manner of usage of the present invention, the same should be apparent from the above description with the drawings.

With the respect to the above description then, it is to be realized that the optimum dimensional relationships for the parts of the invention, to include variations in size, materials, shape, form, function and manner of usage, and assembly are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

I claim:

1. A portable screen wall section, comprising:

a mesh screen or netting fabric;

a border surrounding the mesh screen or netting fabric, the border comprising a front side and a back side and having an elongate open space coextensive with the border between the front side and back side;

a plurality of slits provided in at least one of the front and back sides of the border, the plurality of slits providing access into the opening;

a plurality of rigid support structure members configured to slip through the plurality of slits, the plurality of support structure members having a proximal end and a distal end, the proximal end comprising a female coupler and the distal end comprising a male coupler, the plurality of support structure members configured to couple together in a male coupler to female coupler arrangement thereby providing a substantially rigid structure that supports the mesh screen or netting fabric; and a plurality of straps attached to the boarder and configured to attach the portable screen wall section to a support structure.

2. The portable screen wall section of claim 1, comprising a zipper provided on the portable screen wall section configured to provide access through the mesh screen or netting fabric.

3. The portable screen wall section of claim 2, wherein the border is made of a flexible lightweight, durable outdoor fabric.

4. The portable screen wall section of claim 3, wherein the plurality of support structure members are made of lightweight tubing.

5. The portable screen wall section of claim 4, wherein the female coupler arrangement comprises an elbow at the distal end of the tubing configured to accept the proximal end of the tubing as the male coupler arrangement.

* * * * *